US006318691B1

(12) United States Patent
Toth, Jr. et al.

(10) Patent No.: US 6,318,691 B1
(45) Date of Patent: Nov. 20, 2001

(54) HAIR DRYER HOLDER ENGAGING CABINET DRAWER

(76) Inventors: Steven C. Toth, Jr.; Mary Jo Toth, both of 5307 W. Cheryl Dr., Glendale, AZ (US) 85302

( * ) Notice: Subject to any disclaimer, the term of this patent is extended or adjusted under 35 U.S.C. 154(b) by 0 days.

(21) Appl. No.: 09/099,272

(22) Filed: Jun. 18, 1998

(51) Int. Cl.[7] ..... A47F 5/00

(52) U.S. Cl. ..... 248/314; 248/231.41; 248/309.1; 34/99

(58) Field of Search ..... 248/309.1, 315, 248/205.1, 213.2, 37.3, 37.6, 314, 214, 231.41, 312.1, 231.21, 231.81; 219/242; 312/293.1, 194, 280, 281, 282; 34/96, 97, 99, 101; 211/70.6

(56) References Cited

U.S. PATENT DOCUMENTS

| | | | | |
|---|---|---|---|---|
| D. 275,543 | | 9/1984 | Borgstede, Jr. | D7/70 |
| D. 277,781 | | 2/1985 | Weissenburger | D24/10 |
| D. 335,935 | * | 5/1993 | Rouail | D28/73 |
| D. 335,989 | | 6/1993 | Van Hise | D6/524 |
| 936,104 | * | 10/1909 | Ernest | 248/289.11 |
| 1,288,560 | * | 12/1918 | Gordon | 248/231.41 |
| 1,530,180 | | 3/1925 | Holmes . | |
| 2,511,919 | * | 6/1950 | Jones et al. | 312/208.1 |
| 3,698,675 | | 10/1972 | Lerew et al. | 248/311 |
| 4,225,106 | * | 9/1980 | Eplan | 248/309.1 |
| 4,466,203 | * | 8/1984 | Thomas | 34/99 |
| 4,712,313 | | 12/1987 | Gettleman . | |
| 4,746,090 | * | 5/1988 | Hamilton | 248/314 |
| 4,799,321 | * | 1/1989 | Johnson | 38/103 |
| 5,064,154 | | 11/1991 | Payne | 248/121 |
| 5,279,452 | | 1/1994 | Huynh | 224/42.45 R |
| 5,294,194 | * | 3/1994 | Lombardo | 312/229 |
| 5,485,931 | * | 1/1996 | Barr, Jr. | 211/70.6 |
| 5,560,497 | * | 10/1996 | Mulvihill, Jr. | 211/4 |
| 6,010,104 | * | 1/2000 | Hanson et al. | 248/311.2 |

* cited by examiner

*Primary Examiner*—Anita King
*Assistant Examiner*—Gwendolyn Baxter
(74) *Attorney, Agent, or Firm*—Cahill, Sutton & Thomas P.L.C.

(57) ABSTRACT

A hair dryer holder for supporting a hair dryer from a bathroom vanity drawer includes a generally planar horizontal support member having an aperture formed in a first end thereof for releasably receiving the nozzle of the hair dryer. Forwardmost and rearmost drawer engagers extend downwardly from the horizontal support member spaced apart from each other generally proximate the opposing second end of the horizontal support member. The rearmost and forwardmost drawer engagers extend along opposite sides of a drawer front. The upper surface of said horizontal support member extends under the vanity countertop as the drawer is closed.

12 Claims, 1 Drawing Sheet

HAIR DRYER HOLDER ENGAGING CABINET DRAWER

BACKGROUND OF THE INVENTION

1. Field of the Invention

The present invention relates generally to handheld hair dryers, and more particularly to devices used to support handheld hair dryers.

2. Description of the Related Art

Electric hair dryers are a common appliance used to blow-dry and style one's hair after washing it. Such electric hair dryers typically include a handle and an air-discharge nozzle or snout extending generally perpendicularly from the handle. During the use of such hair dryers, it is often necessary to put the hair dryer down to be able brush or shape the hair. During such instances, users often turn the unit off, and then turn it back on again when blow-drying is to continue. However, continuous starting and stopping of the unit tends to shorten the life of the electric motor and the heater coils within the unit. Some users have attempted to simply leave the unit running on a countertop while manipulating their hair, but the vibration of the motor can send the unit moving across the counter. This poses a safety hazard, as the heated air may be directed against the user's body or against some object that can be damaged by excessive heat; moreover, the hair dryer could fall into a sink filled with water and pose an electrical hazard.

In the past, others have proposed various devices for holding a hair dryer. For example, in U.S. Pat. No. 4,746,090 to Hamilton, a wall-mounted base is provided for permanent attachment to a wall. The base includes an open-sided receiving hole for receiving the handle of the hair dryer, and allows the handle to be rotated to direct heated air in different directions. The holder of the Hamilton patent is described as permitting hands-free operation of the hair dryer and directs heated air in a generally horizontal direction. It is not adapted to permit ready insertion of the hair dryer therein, or ready removal of the hair dryer therefrom.

U.S. Pat. No. 5,064,154 to Payne discloses a stand and holder for a hair dryer. Like the Hamilton device, the holder disclosed by Payne is intended to allow a hair dryer to be used in a hands-free fashion. Also like the Hamilton holder, the Payne holder supports the hair dryer to discharge heated air in a generally horizontal direction. One of the objects stated in the Payne patent is to provide such a holder that is free standing. However, the stand complicates the device and increases-its expense.

U.S. Pat. No. 4,712,313 to Gettleman discloses a clamp for engaging the air outlet end of an electric hair dryer; a relatively complicated pair of pivoting arms are used to support the hair dryer from a wall or stand.

U.S. Pat. No. 5,485,931 to Barr, Jr. discloses a wall-mounted hair dryer caddy which has a hole formed therein to engage the handle of the hair dryer in a manner which permits heated air to be discharged in a generally horizontal direction. Like the Hamilton and Payne holders, the Barr, Jr. holder is intended to support the hair dryer for hands-free operation.

U.S. Design Patent No. Des. 335,935 illustrates a support bracket for a hair dryer. While no textual description is provided in such patent, the illustrated bracket includes a pair of holes which appear to be intended to receive mounting screws for mounting such bracket to a vertical support surface, such as a wall.

None of the aforementioned hair dryer holders provides a simple and inexpensive holder to temporarily support a hair dryer while allowing the user to quickly insert, and quickly remove, the hair dryer therefrom for hand operation of the hair dryer.

Accordingly, it is an object of the present invention to provide a simple and inexpensive apparatus to support an electric hair dryer.

It is a another object of the present invention to provide such an apparatus which safely allows the hair dryer to be left on and running while the user manipulates and styles his or her hair.

It is still another object of the present invention to provide such an apparatus which can be quickly and easily secured to a conventional bathroom cabinet drawer, or removed therefrom, as desired without the need for tools, screws, or the like.

It is a still further object of the present invention to provide such an apparatus which is adapted to releasably engage the nozzle, or air-discharge end, of a conventional hair dryer for directing heated air safely toward the floor.

These and other objects of the present invention will become more apparent to those skilled in the art as the description of the present invention proceeds.

SUMMARY OF THE INVENTION

Briefly described, and in accordance with a preferred embodiment thereof, the present invention relates to a hair dryer holder used to support a hair dryer from a pullout drawer. The hair dryer holder includes a generally planar support member having opposing first and second ends. The first end of the planar support member includes a nozzle engager for releasably engaging the nozzle of the hair dryer. The second end of the planar support member is supported upon the drawer front of the pullout drawer. A first, or forwardmost, drawer engager, and a second, or rearmost, drawer engager are both coupled to the planar support member near its second end. The forwardmost and rearmost drawer engagers are spaced apart from each other by at least the width of the drawer front; these members are themselves preferably planar, and may extend perpendicularly downward from the second end of the planar support member. The forwardmost drawer engager extends in front of the drawer front, and the rearmost drawer engager extends behind the drawer front. The forwardmost and rearmost drawer engagers cooperate with the planar support member to support the hair dryer upon the pullout drawer.

In the preferred embodiment of the present invention, the nozzle engager provided at the first end of the planar support member is an aperture formed therein for receiving the nozzle of the hair dryer. The aperture is preferably circular in shape and has a diameter commensurate with the outer diameter of the nozzle of the hair dryer.

Most typically, the pullout drawer is housed within a bathroom vanity which includes a countertop that normally covers the pullout drawer. Preferably, the pullout drawer is partially closed after the hair dryer holder is installed for allowing the second end of the planar support member to extend under the countertop for additional stability.

Another aspect of the present invention relates to an assemblage of a hair dryer and a hair dryer holder, of the type described above, for supporting the hair dryer from a pullout drawer. The forwardmost and rearmost drawer engagers cooperate with the generally planar support member to support the assemblage of the hair dryer and the hair dryer holder upon the pullout drawer.

A further aspect of the present invention relates to a method for supporting a hair dryer from the drawer front of a pullout drawer of a cabinet or vanity. The hair dryer includes a handle portion for being grasped by a user and an air discharge nozzle for blowing hot air. The method includes the step of providing a generally planar support member having front and rear opposing ends, and releasably engaging the nozzle of the hair dryer with the front end of the generally planar support member; this releasably engaging step is preferably accomplished by extending the nozzle of the hair dryer through an aperture formed within the front end of the generally planar support member. The method of the present invention further includes the step of supporting the rear end of the planar support member upon the drawer front for allowing the generally planar support member to extend generally horizontally therefrom, with the nozzle of the hair dryer being directed downwardly toward the floor. To further stabilize the generally planar support member, the pullout drawer is preferably closed after the step of supporting the rear end of the planar support member upon the drawer front. This step advantageously engages the apparatus between the top of the drawer front and the countertop of the cabinet or vanity for additional stability.

DETAILED DESCRIPTION OF THE PREFERRED EMBODIMENTS

Figure 1:
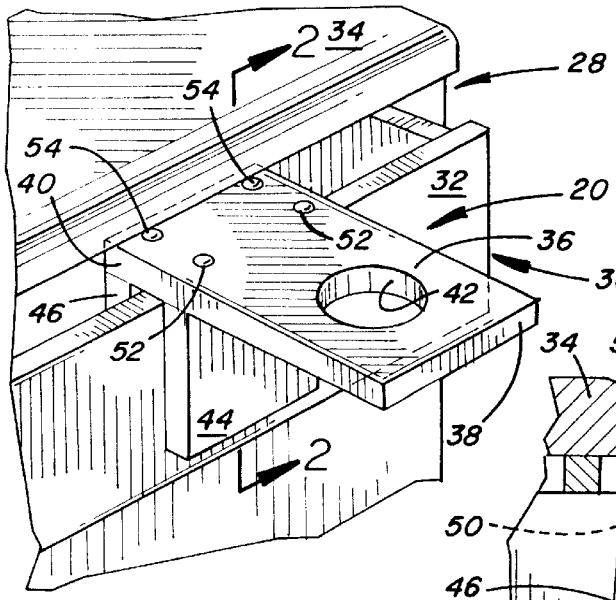
FIG. 1 is a perspective view of a hair dryer holder secured over the front face of a bathroom cabinet drawer.
Figure 2:
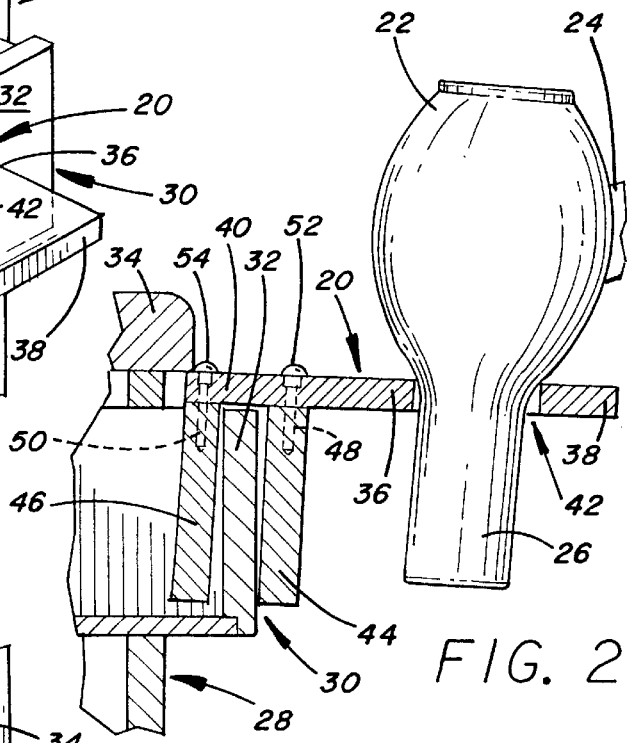
FIG. 2 is a sectional view of the hair dryer holder and cabinet drawer of FIG. 1 taken through the plane indicated by lines 2—2 FIG. 1, and showing a hair dryer supported thereby.
Figure 3:
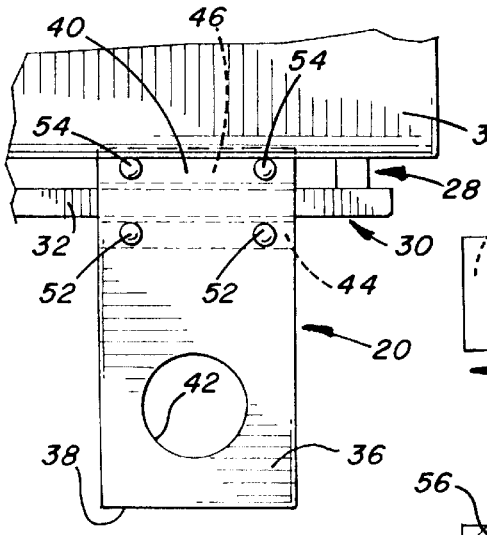
FIG. 3 is a top view of the hair dryer holder shown in FIG. 1.

A preferred form of hair dryer holder for supporting a hair dryer from a pullout cabinet drawer, in accordance with the teachings of the present invention, is designated generally within FIGS. 1–3 by reference numeral 20. A conventional electric hair dryer 22 is shown in FIG. 2 and includes a handle 24 for being held by a user, and a generally cylindrical air discharge nozzle or barrel 26 for blowing heated air. Also shown in FIGS. 1–3 is a conventional bathroom vanity cabinet unit 28 including a pullout drawer 30 that is housed therein. Pullout drawer 30 includes a drawer front 32. Vanity cabinet unit 28 includes a countertop 34 which covers pullout drawer 30 when pullout drawer 30 is in its closed position.

Hair dryer holder 20 includes a generally planar support member 36 having a first, or front, end 38, and a second, or rear, opposing end 40. A circular aperture 42 is formed within the front end 38 of support member 36. This aperture has a diameter slightly larger than the outer diameter of the discharge nozzle 26 of hair dryer 22 for releasably engaging nozzle 26 of hair dryer 22; in that sense, aperture 42 may be considered as one form of a nozzle engager.

It is desired to position support member 36 so that it extends generally horizontally, thereby allowing nozzle 26 of hair dryer 22 to be directed downwardly toward the floor. It is also desired to secure support member 36 from drawer front 32, preferably in a manner which allows hair dryer holder 20 to be easily installed thereon or removed therefrom. To this end, hair dryer holder 20 includes a pair of drawer engagers for engaging the front and rear faces of drawer front 32. Forwardmost drawer engager 44 is coupled to support member 36 near second end 40 for extending in front of drawer front 32. Rearmost drawer engager 46 is also coupled to support member 36 near second end 40 thereof and is spaced apart from forwardmost drawer engager 44 for extending just behind drawer front 32. Preferably, the spacing between forwardmost and rearmost drawer engagers 44 and 46, respectively, is slightly greater than the thickness of drawer front 32. Forwardmost drawer engager 44 and rearmost drawer engager 46 cooperate with support member 36 to support hair dryer holder 20, and hence hair dryer 22, from drawer front 32 of pullout drawer 30.

For purposes of manufacture, support member 36, forwardmost drawer engager 44 and rearmost drawer engager 46 may all be made of wood, a poor conductor of heat. Forwardmost drawer engager 44 and rearmost drawer engager 46 may be generally planar members that extend perpendicularly downward from support member 36 below second end 40 thereof In the preferred embodiment of the present invention, the upper edges of forwardmost drawer engager 44 and rearmost drawer engager 46 are secured to the bottom of support member 36 by screws 48 and 50. If desired, dado grooves may be routed in the bottom portion of support member 36 to receive the upper edges of forwardmost drawer engager 44 and rearmost drawer engager 46. The heads of such screws 48 and 50 may be covered, for decorative purposes, by wooden caps 52 and 54, respectively, which are glued to support member 36 to conceal screws 48 and 50. Alternatively, such components may be formed of plastic rather than wood, and maybe as an integral unit or formed as separate pieces that are secured together in the manner described.

As shown in FIGS. 1–3, once hair dryer holder 20 is installed over drawer front 32, pullout drawer 30 is preferably closed until rear end 40 of support member 36 extends underneath countertop 34. The engagement of the rear end 40 of support member 36 between the upper edge of drawer front 32 and the bottom of the countertop increases the stability of hair dryer holder 20.

As mentioned above, another aspect of the present invention relates to a method of supporting hair dryer 22 from pullout drawer 30 of vanity cabinet 28. In practicing such method, generally planar support member 36 is provided, and nozzle 26 of hair dryer 22 is releasably engaged with front end 38 thereof The opposing rear end 40 of support member 36 is supported upon drawer front 32 for allowing support member 36 to extend generally horizontally therefrom, with nozzle 26 of hair dryer 22 being directed generally downwardly. The rear end 40 of support member 36 can be supported from drawer front 32 by engaging front and rear engaging members. 46 and 44 each coupled to the rear end 40 of support member 36, with the front and rear faces of drawer front 32.

In practicing the aforementioned method, the nozzle 26 of hair dryer 22 is preferably releasably engaged with front end 38 of support member 36 by extending nozzle 26 through an aperture 42 formed within front end 38 of support member 36. In addition, pullout drawer 30 is preferably closed after the rear end of support member 36 is engaged with drawer front 32, for engaging rear end 40 of support member 36 under countertop 34 as pullout drawer 30 is closed.

Figure 4:
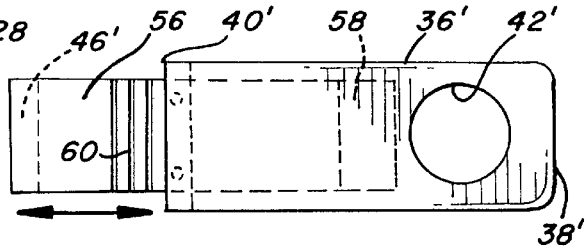
FIG. 4 is a top view of an alternate embodiment of the hair dryer incorporating an adjustable spacing feature.
Figure 5:
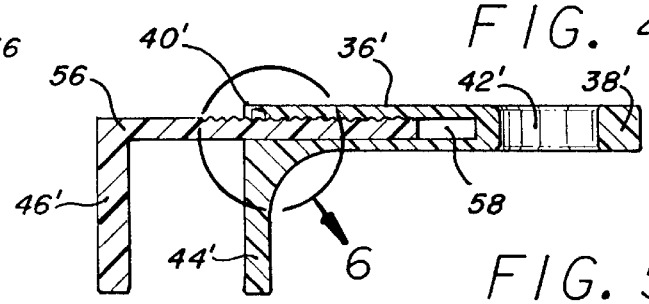
FIG. 5 is a cross-sectional view of the hair dryer holder shown in FIG. 5.
Figure 6:
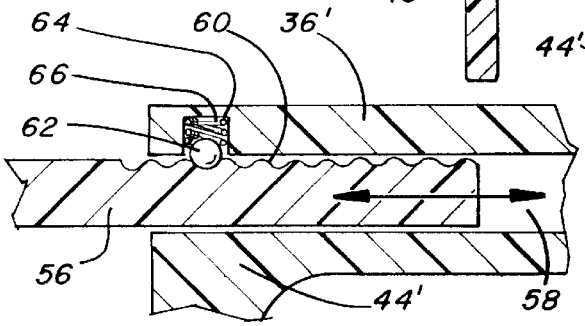
FIG. 6 is an enlarged view of the portion of the hair dryer holder shown within the dashed circled area of FIG. 5.

Referring now to FIGS. 4–6, an alternate embodiment of the present invention is shown, wherein components corresponding to those already identified above in regard to FIGS. 1–3 have been identified by like primed reference numerals. The embodiment shown in FIGS. 4–6 includes the feature of allowing the spacing between forwardmost drawer engager 44' and rearmost drawer engager 46' to be adjusted to accommodate drawer fronts of varying widths. As shown in FIGS. 4–6, rearmost drawer engager 46' extends downwardly from a bracket member 56. Bracket member 56 extends telescopically within a hollow chamber 58 formed within support member 36', which hollow chamber opens adjacent rear end 40' of support member 36'. Thus, bracket member 56 can be extended into, or retracted from, hollow chamber 58 of support member 36' in order to vary the spacing between forwardmost drawer engager 44' and rearmost drawer engager 46'.

In order to maintain bracket 36' at a desired location, a series of grooves 60 extend across the upper surface of bracket 36'. A ball 62 is disposed within a pocket 64 formed in support member 36'; biasing spring pushes ball 62 downwardly against grooves 60 of bracket 56. The ball 62 settles within the depression formed by one of such grooves 60 and provides some resistance to sliding motion of bracket 56 relative to support member 36'. However, if sufficient sliding force is applied by the user, ball 62 will compress spring 66 and allow bracket 56 to be further extended or retracted to adjust the spacing between forwardmost drawer engager 44' and rearmost drawer engager 46'.

Those skilled in the art will now appreciate that a simple and inexpensive apparatus has been described for supporting an electric hair dryer from the drawer front of a bathroom vanity pullout drawer. The disclosed hair dryer holder can be quickly and easily secured to a conventional bathroom cabinet drawer, or removed therefrom, as desired without the need for tools, screws, or the like. The disclosed apparatus positions the nozzle of the hair dryer to be directed toward the floor of the bathroom, and allows the hair dryer to be left on and running safely while the user manipulates and styles his or her hair. The hair dryer holder described above is adapted to easily and quickly engage the nozzle of the hair dryer while allowing the hair dryer to be just as easily removed therefrom. Those skilled in the art will also appreciate that an improved method has been described for releasably supporting a hair dryer from a pullout drawer of a bathroom vanity cabinet unit. While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A hair dryer holder for supporting a hair dryer of the type having an air-discharge nozzle from a pullout drawer of the type having a drawer front, the hair dryer holder comprising in combination:

a. a generally planar support member having first and second opposing ends, the first end thereof having a nozzle engager for releaseably engaging the nozzle of a hair dryer;

b. a forwardmost drawer engager coupled to said support member proximate the second end thereof for extending in front of the drawer front, said forwardmost drawer engager being generally planar and extending generally perpendicular to said support member; and c. a rearmost drawer engager coupled to said support member proximate the second end thereof, said rearmost drawer engager being generally planar and extending generally perpendicular to said support member, said rearmost drawer engager extending generally parallel to said forwardmost drawer engager and spaced apart from said forwardmost drawer engager for extending behind the drawer front, the rearmost drawer engager being spaced apart from said forwardmost drawer engager by a separation distance;

d. said forwardmost drawer engager and said rearmost drawer engager each extending downwardly from said generally planar support member by at least the separation distance and cooperating with said generally planar support member to support a hair dryer upon a pullout drawer.

2. The hair dryer holder recited by claim 1 wherein said nozzle engager at the first end of said generally planar support member is an aperture formed in the first end of said generally planar support member for receiving the nozzle of the hair dryer.

3. The hair dryer holder recited by claim 2 wherein said aperture is generally circular in shape.

4. Apparatus for supporting a hair dryer of the type having an air-discharge nozzle comprising in combination:

a. a cabinet having a pullout drawer, said pullout drawer including a drawer front;

b. a generally planar support member having first and second opposing ends, the first end thereof having a nozzle engager for releaseably engaging the nozzle of a hair dryer;

c. a forwardmost drawer engager coupled to said support member proximate the second end thereof for extending in front of said drawer front, said forwardmost drawer engager being generally planar and extending generally perpendicular to said support member; and d. a rearmost drawer engager coupled to said support member proximate the second end thereof and spaced apart from said forwardmost drawer engager for extending behind said drawer front, said rearmost drawer engager being generally planar and extending generally perpendicular to said support member, the rearmost drawer engager being spaced apart from said forwardmost drawer engager by a separation distance;

e. said forwardmost drawer engager and said rearmost drawer engager each extending downwardly from said generally planar support member by at least the separation distance and cooperating with said generally planar support member to support a hair dryer upon said pullout drawer.

5. The apparatus recited by claim 4 wherein said nozzle engager at the first end of said generally planar support member is an aperture formed in the first end of said generally planar support member for receiving the nozzle of the hair dryer.

6. The apparatus recited by claim 5 wherein said aperture is generally circular in shape.

7. A combined hair dryer and hair dryer holder assembly for supporting the hair dryer from a pullout drawer of the type having a drawer front, said assembly comprising in combination:

a. a hair dryer having a handle for being held by a user and having an air discharge nozzle for blowing heated air;

b. a generally planar support member having first and second opposing ends, the first end thereof having a nozzle engager for releasably engaging the nozzle of the hair dryer;

c. a forwardmost drawer engager coupled to said support member proximate the second end thereof for extending in front of the drawer front, said forwardmost drawer engager being generally planar and extending generally perpendicular to said support member; and d. a rearmost drawer engager coupled to said support member proximate the second end thereof and spaced apart from said forwardmost drawer engager for extending behind the drawer front, said rearmost drawer engager being generally planar and extending generally perpendicular to said support member, said rearmost drawer engager extending generally parallel to said forwardmost drawer engager and being spaced apart from said forwardmost drawer engager by a separation distance;

e. said forwardmost drawer engager and said rearmost drawer engager each extending downwardly from said generally planar support member by at least the separation distance and cooperating with said generally planar support member to support the combined hair dryer and hair dryer holder assembly upon the pullout drawer.

8. The combined hair dryer and hair dryer holder assembly recited by claim 7 wherein said nozzle engager at the first end of said generally planar support member is an aperture formed in the first end of said generally planar support member for receiving the nozzle of the hair dryer.

9. The combined hair dryer and hair dryer holder assembly recited by claim 8 wherein the nozzle of said hair dryer is generally cylindrical and has a predetermined outer diameter, and wherein said aperture is generally circular in shape and has a diameter commensurate with said predetermined diameter of the nozzle.

10. A method of supporting a hair dryer from a pullout drawer of a cabinet, the hair dryer including a handle portion for being grasped by a user and having an air discharge nozzle for blowing hot air, the pullout drawer including a drawer front, said method comprising the steps of:

a. providing a generally planar support member having front and rear opposing ends;

b. releasably engaging the nozzle of the hair dryer with the front end of the generally planar support member;

c. supporting the rear end of the generally planar support member upon the drawer front for allowing the generally planar support member to extend generally horizontally therefrom, with the nozzle of the hair dryer being directed generally downwardly; and d. closing the pullout drawer after the step of supporting the rear end of the generally planar support member upon the drawer front.

11. The method recited by claim 10 wherein the cabinet includes a countertop, and wherein the step of closing the pullout drawer includes the step of engaging the rear end of the generally planar support member under the countertop as the pullout drawer is closed.

12. The method recited by claim 10 wherein the step of releasably engaging the nozzle of the hair dryer with the front end of the generally planar support member includes the step of extending the nozzle through an aperture formed within the front end of the generally planar support member.

* * * * *